United States Patent [19]

Brill

[11] 3,954,208

[45] May 4, 1976

[54] DISPENSER VALVE STRUCTURE

[76] Inventor: Roy N. Brill, 400 Park Ave., Highland Park, Ill. 60035

[22] Filed: Jan. 8, 1975

[21] Appl. No.: 539,402

[52] U.S. Cl. ..... 222/402.23; 251/249

[51] Int. Cl.[2] ..... B65D 83/14

[58] Field of Search ..... 239/524; 222/402.24, 222/402.25, 402.21–402.23, 394; 251/249

[56] References Cited

UNITED STATES PATENTS

| | | | |
|---|---|---|---|
| 2,487,434 | 11/1949 | Geiss et al. | 222/402.23 |
| 2,772,035 | 11/1956 | Collins et al. | 222/402.23 |
| 3,079,048 | 2/1963 | Wolfson et al. | 222/402.23 X |
| 3,722,760 | 3/1973 | Hug | 222/402.22 |
| 3,747,851 | 7/1973 | Conrad | 239/524 X |
| 3,758,007 | 9/1973 | Rosen | 222/402.23 X |

FOREIGN PATENTS OR APPLICATIONS

| | | | |
|---|---|---|---|
| 974,385 | 11/1964 | United Kingdom | 222/182 |

*Primary Examiner*—Stanley H. Tollberg
*Assistant Examiner*—Charles A. Marmor
*Attorney, Agent, or Firm*—Max R. Kraus

[57] ABSTRACT

A dispenser valve structure for use in combination with a container for dispensing liquids under pressure, in the form of whipping and shaving creams and the like, in which the container includes a closure having an opening therethrough. The dispenser valve structure has a resilient tubular plug extending through said opening and has a flange engaging the undersurface of said closure and an annular outwardly extending shoulder above said flange, with the underside of said shoulder engaging the container closure to secure the plug to the closure. The plug is provided with a valve seat on its inner side and the plug has a tubular portion which has an exterior annular recess or groove and in which the separate nozzle which fits over the plug has an inwardly extending annular member or ring which engages the groove in the plug to secure the nozzle to the plug. The outer or upper end of the nozzle is slotted to form finger-like tips. The dispenser valve structure has a stem positioned within the tubular plug with the stem being provided at its inner end with a valve head adapted to engage the valve seat of the plug. The stem has a deflector which deflects the discharged cream radially through the slotted finger-like tip end of the nozzle.

8 Claims, 4 Drawing Figures

DISPENSER VALVE STRUCTURE

BRIEF SUMMARY OF THE INVENTION

The dispenser valve structure of this invention is used principally with aerosol containers in which whipped cream, shaving cream, or any other product which is to be whipped is to be discharged in a foam.

One of the objects of this invention is to provide a dispenser valve structure in which the nozzle is secured to the resilient plug body in contradistinction to other valve structures in which the nozzle is secured by means of the valve stem unit.

Another object of this invention is to provide a valve stem unit structure with deflecting means which will deflect the discharged whipping or shaving cream more or less radially of the nozzle rather than in an axial direction axially of the valve stem. This deflection of the discharged cream through the V-slots of the nozzle will cause the whipped cream to be fluted which enhances its appearance.

Another object of this invention is to provide a dispenser valve structure which is economical to produce and easy to assemble.

Figure 4:
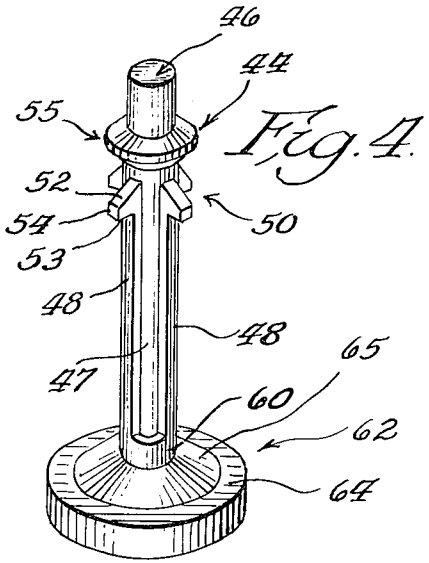
FIG. 4 is a perspective view of the valve stem unit.

The numeral 12 designates a conventional can or container for aerosol products which is provided at its upper end with a rolled-over edge 14. A closure 16 for the can or container has a peripheral edge 18 rolled about the rolled-over edge 14 for securement thereto. A resilient gasket 20 of rubber or the like is secured between the rolled-over edges 14 and 18 to provide a tight seal therebetween to prevent leakage. This is conventional in the art.

The closure 16 has a central opening 22 encompassed by an upstanding annular rim 24. Secured to the closure 16 is a plug or body, generally indicated at 26, which is formed of resilient material such as rubber or the like having a central passage or bore 28 of uniform diameter throughout the length of the plug. The plug 26 extends through the opening 22 of the closure 16 and is enlarged at the lower end thereof to provide a flange or enlargement 32 which rests against the underside of the closure 16. The bottom surface 34 of the enlargement or flange 32 forms the valve seat, as will be subsequently described. The tubular portion of the plug is provided with an annular enlargement or bead or boss 35, the bottom or lower edge 36 forming a shoulder which seats against the top of the annular rim 24 to securely lock the plug 26 to the container. The upper portion of the enlargement or boss 35 inclines or tapers upwardly and inwardly to form a tapered or angled shoulder 37 where it merges into the tubular body portion 38 of the plug. The taper of the shoulder 37 is approximately 45°.

The tubular body portion 38 of the shoulder 37 has a slight inwardly inclined taper indicated at 39 which extends to almost the upper portion of the tubular body 38. The upper portion of the tubular body has a top tapered or beveled edge 40 with a top planar surface 41. The tubular body portion 38 has an annular recess or groove 42 intermediate the shoulder 37 and the top 41. The annular recess or groove 42 serves as the means to which the tubular nozzle is anchored or secured, as will be subsequently described.

The valve stem unit generally indicated at 44 includes a central stem 46, the central portion 47 of which is circular in cross-section, which is provided with four equally spaced radially extending elongated ribs 48, each of which terminates at the top in an outwardly extending projection generally indicated at 50, the top of which is inclined as at 52 with the underside 53 thereof perpendicular to the rib 48 and with the outer end 54 being vertical and planar. Positioned above the projections 50 is an annular deflector generally indicated at 55 comprising an outwardly and upwardly inclined underside 56 with an outwardly and downwardly inclined topside 58 which merge into an annular outer vertical surface 59. The lower ends of the spaced ribs 48 merge into an annular surface 60 at the bottom of the stem. The lower end of the stem has an integrally formed annular disk generally indicated at 62 which has a flat outer annular portion 64 and a slightly raised inner annular tapering portion 65 which forms the valve portion of the valve stem unit. The entire valve stem unit 44 is integrally molded of plastic material. The outwardly extending projections 50 serve to prevent the valve stem unit 44 from slipping out of the plug 26 after it is inserted, yet permits insertion of the valve stem unit into plug.

Figure 2:
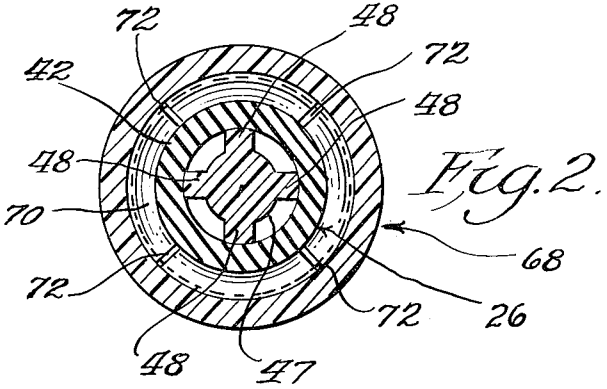
FIG. 2 is a sectional view taken on line 2—2 of FIG. 1.
Figure 3:
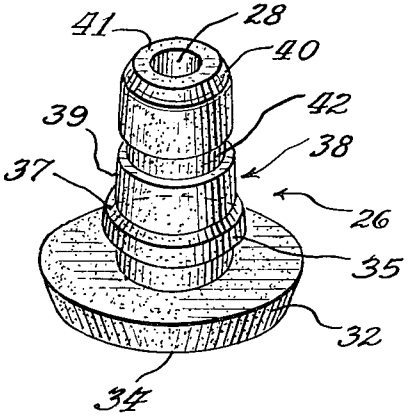
FIG. 3 is a perspective view of the resilient plug.
Figure 1:
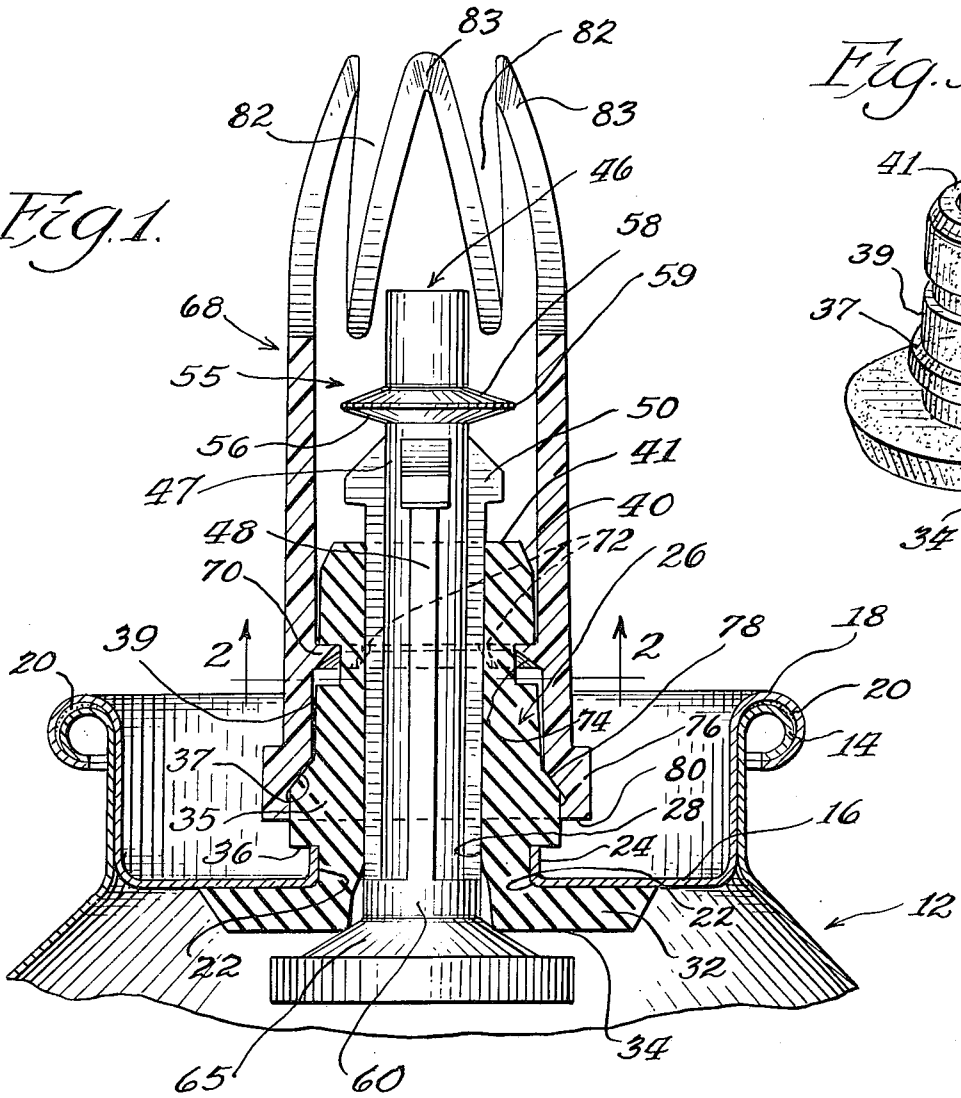
FIG. 1 is an enlarged central sectional view of the valve structure of this invention attached to an aerosol container.

A tubular nozzle generally indicated at 68 formed of a rigid plastic material encompasses and envelops a portion of plug 26, including the bead or boss 35 of the plug. The nozzle 68 is provided with an inside annular or circumferential bead or ring 70 provided with a plurality of equally spaced splits 72 (best seen in FIG. 2). The underside of the split bead or ring 70 is tapered as at 74. Said split bead or ring 70 engages the annular recess or groove 42 of the resilient plug 26, as shown in FIG. 1, to secure and retain the nozzle 68 attached to the resilient plug 26. The split ring 70 facilitates the insertion of the nozzle over the resilient plug 26 and provides sufficient "give" so that the split ring 70 can be locked into the groove 42 of the plug 26.

The lower end of the nozzle 68 has an enlarged skirt portion 76 having a greater inside diameter than that of the inside of the body of the nozzle which tapers inwardly as at 78 to merge with the body of the nozzle. The angle of the taper 78 is complementary to the taper of shoulder portion 37 of the plug 26 with which it engages when the nozzle is in upright position as shown in FIG. 1, with the valve seated in closed position. The lower edge 80 of the skirt portion 76 of the nozzle extends slightly short of the lower edge or bottom 36 of the shoulder 35 of the plug 26. The upper end of the nozzle 68 curves inwardly and is provided with a plurality of radially spaced slots 82 of a V-shaped configuration, which forms spaced inwardly curved fingers 83 at the upper end of the nozzle.

The parts are assembled by inserting the valve stem unit 44 into the plug 26 through the bottom of the plug and the nozzle 68 is inserted over the valve stem unit 44 and the plug 26 so that the split ring 70 of the nozzle engages and is received in the annular recess or groove 42 of the plug 26. This locks the nozzle 68 directly to the plug 26 and does not utilize the valve stem unit for locking the nozzle thereto.

As shown in FIG. 1, the valve stem is in its fully upright position so that the valve closes the entrance to the plug 26 and prevents the escape of any aerosol material in the container. When the nozzle is manually tilted in the conventional manner the valve will be displaced from its valve seating position and permit passage of the aerosol contents through the interior of the plug and between the valve stem and the plug. As the aerosol material strikes the deflector 55 the aerosol material will be deflected to the V-shaped slots 82 of the nozzle and will pass therethrough more or less radially of the nozzle rather than in a direct axial direction axially of the valve stem.

This invention has a particular application in connection with aerosol containers which dispense whipping cream, shaving cream, or any product which is to be whipped or be discharged in a foam. The material in the aerosol container is in a liquid state and as it is dispensed the cream actually whips due to the action of the gas and the opening of the valve. With this invention the whipping cream will be deflected by the deflector 54 so that it passes radially between the V-shaped slots 82 of the nozzle 68 and cause the cream to be fluted which enhances its appearance.

What is claimed is:

1. In combination with a container for dispensing liquids under pressure, said container including a closure having an opening therethrough, a resilient tubular plug extending through said opening and having a flange engaging the undersurface of said closure and an annular outwardly extending shoulder above said flange, with the underside of said shoulder engaging the container closure to secure said plug to said closure, said plug having a valve seat on its inner side, said plug having a tubular portion providing a bore, a separate nozzle having a tubular body, said nozzle positioned on said tubular portion of said plug, with the tubular body portion of the nozzle surrounding the tubular portion of the plug and the lower end of the body portion of the nozzle extending exteriorly around the plug, said nozzle formed to provide a plurality of spaced slots on the outer end thereof, the body of said nozzle and said tubular portion of said plug having cooperating means engaging each other to retain said nozzle on said plug, said cooperating means positioned respectively on the interior of the body of the nozzle and on the exterior of the tubular portion of the plug and intermediate the top and bottom of said nozzle body and said tubular portion of said plug, a valve stem unit including a stem positioned within said tubular plug, said stem being provided at its inner end with a valve head which engages the valve seat of said plug to close the entrance to said plug and block the discharge of the pressurized liquid, said valve stem having a plurality of spaced vertically extending ribs providing passage spaces between the stem and said bore, said stem having a deflector means positioned above said ribs, said deflector means causes the discharged material to be deflected in a generally radial direction to pass between the slots in said nozzle, and said stem having an outwardly extending projection formed at the top of said ribs below said deflector means.

2. A dispenser valve structure as set forth in claim 1 in which the cooperating means between the plug and the nozzle comprises an annular recess in one and an annular projection in the other which interengage.

3. A dispenser valve structure as set forth in claim 1 in which the cooperating means between the plug and the nozzle comprises an exteriorly facing annular groove in the tubular portion of the body of the plug and an inwardly extending projection on the body of the nozzle which engages said groove.

4. A dispenser valve structure as set forth in claim 3 in which the inwardly extending projection on the body of the nozzle is of annular shape.

5. A dispenser valve structure as set forth in claim 4 in which the annular inwardly extending projection on the body of the nozzle is provided with a plurality of circumferentially spaced splits.

6. A dispenser valve structure as set forth in claim 3 in which the inwardly extending projection of said nozzle comprises a split ring and in which the split ring is received within the annular groove of the plug, and in which the slots on the outer end of the nozzle form spaced inwardly curved fingers at the outer end of the nozzle.

7. A dispenser valve structure as set forth in claim 1 in which the deflector means is positioned below the bottom of the slots of said nozzle to cause said discharged material to pass through said slots in a fluted condition.

8. A dispenser valve structure as set forth in claim 1 in which the deflector means comprises an outwardly inclined underside.

* * * * *